US008682228B2

(12) United States Patent
Mukataka et al.

(10) Patent No.: US 8,682,228 B2
(45) Date of Patent: Mar. 25, 2014

(54) DEVELOPER APPARATUS AND IMAGE FORMING APPARATUS COMPRISING THE SAME

(75) Inventors: Hisashi Mukataka, Osaka (JP); Masashi Fujishima, Osaka (JP); Yukihiro Mori, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/469,812

(22) Filed: May 21, 2009

(65) Prior Publication Data

US 2009/0290912 A1 Nov. 26, 2009

(30) Foreign Application Priority Data

May 23, 2008 (JP) ..... 2008-135045
May 15, 2009 (JP) ..... 2009-119118

(51) Int. Cl.
*G03G 15/08* (2006.01)
*G03G 15/06* (2006.01)
*G03G 15/09* (2006.01)

(52) U.S. Cl.
USPC ..... 399/265; 399/277; 399/53

(58) Field of Classification Search
USPC ..... 399/267, 275, 277, 272, 265, 53, 222, 399/228, 229, 279, 282, 286
See application file for complete search history.

(56) References Cited

U.S. PATENT DOCUMENTS

2003/0049054 A1* 3/2003 Ozawa et al. ..... 399/272
2004/0228661 A1* 11/2004 Fujishima et al. ..... 399/279
2008/0124137 A1* 5/2008 Nakaue et al. ..... 399/277
2008/0220360 A1* 9/2008 Hasegawa ..... 430/109.3

FOREIGN PATENT DOCUMENTS

JP 03-100687 4/1991
JP 2002-62684 2/2002
JP 2005-274924 10/2005
JP 2007-322446 12/2007

* cited by examiner

*Primary Examiner* — David Porta
*Assistant Examiner* — Yara B Green
(74) *Attorney, Agent, or Firm* — Gerald E. Hespos; Michael J. Porco; Matthew T. Hespos

(57) ABSTRACT

A developer includes a developer carrying body that carries a two-component developer having a magnetic toner and a carrier. A toner carrying body opposes the developer carrying body and receives toner from the developer carrying body. An image carrying body develops an electrostatic latent image by toner carried on the toner carrying body. A first magnetic member is inside the developer carrying body and opposes a surface of the toner carrying body. A second magnetic member is inside the toner carrying body and opposes the surface of the developer carrying body. The second magnetic member is magnetized to an opposite polarity to the first magnetic member and generates a magnetic force at least on the surface of the toner carrying body in a range of 25 mT to 40 mT in a direction perpendicular to the surface of the toner carrying body.

8 Claims, 3 Drawing Sheets

DEVELOPER APPARATUS AND IMAGE FORMING APPARATUS COMPRISING THE SAME

BACKGROUND OF THE INVENTION

1. Field of the Invention

The present invention relates to a developer apparatus which develops an electrostatic latent image formed on an image carrying body by means of a two-component developer, and an image forming apparatus, such as a copying machine, printer, and the like, which comprising such the developer apparatus.

2. Description of the Related Art

In an image forming apparatus, such as a copying machine, printer, or the like, which forms an image on paper by means of an electrophotographic method, an electrostatic latent image formed on an image carrying body, such as a photosensitive drum, is developed by a developer apparatus and converted into a real toner image. This toner image is transferred onto paper by a transfer apparatus. The paper onto which the toner image has been transferred is conveyed to a fixing apparatus, and heated and pressurized by the fixing apparatus, thereby fixing the toner image, whereupon the paper is output from the machine. By this means, one sequence of an image forming operation is completed.

By the way, there are developer apparatuses which develop an electrostatic latent image on an image carrying body by using a two-component developer comprising a toner and a carrier. Such a developer apparatus comprises a toner carrying body, such as a developer roller, which is disposed so as to oppose an image carrying body, and a two-component developer carrying body, such as a magnetic roller, which is disposed in the vicinity of the toner carrying body. In a developer apparatus of this kind, a thin layer of toner is formed on the toner carrying body by supplying the toner of the two-component developer carried on the two-component developer carrying body to the toner carrying body. And, the electrostatic latent image on the image carrying body is developed by this toner layer (touchdown development) and thus converted into a real toner image.

In a developer apparatus such as that described above, it is necessary to carry out the formation of the thin layer of toner on the toner carrying body and the recovery of undeveloped toner on the toner carrying body, in a simultaneous fashion. Consequently, there have been problems such as a ghost phenomenon in which the historical trace of previous toner consumption is left in the thin layer of toner on the toner carrying body due to defects in recovering the undeveloped toner, or the like, or the problem of charging up of the toner on the toner carrying body.

In order to resolve the problem described above, Japanese Patent Application Laid-open No. 2005-274924, for instance, proposes disposing a magnetic pole on the opposite side of the toner carrying body from the two-component developer carrying body, and promoting the recovery of undeveloped toner from the toner carrying body by creating a strong magnetic brush between the toner carrying body and the two-component developer carrying body.

By the way, in recent years, printers and copying machines capable of outputting at speeds of 50 pages per minute in the case of color machines, have been developed, and high-speed printers and copying machines exceeding an output speed of 100 pages per minute in the case of monochrome machines have been developed.

If the touchdown developing method proposed in Japanese Patent Application Laid-open No. 2005-274924 is adopted in a high-speed machine of this kind, in order to form a sufficient thin layer of toner on the toner carrying body, it is necessary to respond by raising the concentration of toner in the two-component developer, or raising the bias voltage for forming the thin layer or toner, or the like. If measures of this kind are adopted, then scattering of toner is liable to occur between the toner carrying body and the two-component developer carrying body. Furthermore, there are also problems in that leaks are liable to occur between the toner carrying body and the two-component developer carrying body, giving rise to image abnormalities in which the image is not printed accurately onto the paper, as well as causing soiling of the interior of the apparatus.

SUMMARY OF THE INVENTION

The object of the present invention is to provide a developer apparatus and an image forming apparatus comprising the same, whereby images can be formed stably and a soiling of an interior of the apparatus due to scattering of the toner can be prevented, even if the image output speed is high.

The developer apparatus relating to one aspect of the present invention which achieves this object is a developer apparatus comprising: a cylindrical two-component developer carrying body which carries a two-component developer comprising a toner composed of a magnetic toner containing magnetic powder, and a carrier; a cylindrical toner carrying body, which is provided opposing the two-component developer carrying body, and receives the toner from the two-component developer carrying body and carries the toner; and an image carrying body for developing an electrostatic latent image by means of the toner carried on the toner carrying body; wherein a first magnetic member is provided inside the two-component developer carrying body at a position opposing a surface of the toner carrying body, and a second magnetic member, which is magnetized to an opposite polarity to the first magnetic member and generates a magnetic force at least on the surface of the toner carrying body in a range of 25 mT to 40 mT in a direction perpendicular to the surface of the toner carrying body, is provided inside the toner carrying body at a position opposing the surface of the two-component developer carrying body.

DESCRIPTION OF THE PREFERRED EMBODIMENTS

Below, an embodiment of the present invention is described with reference to the accompanying drawings.

[Image Forming Apparatus]

Figure 1:
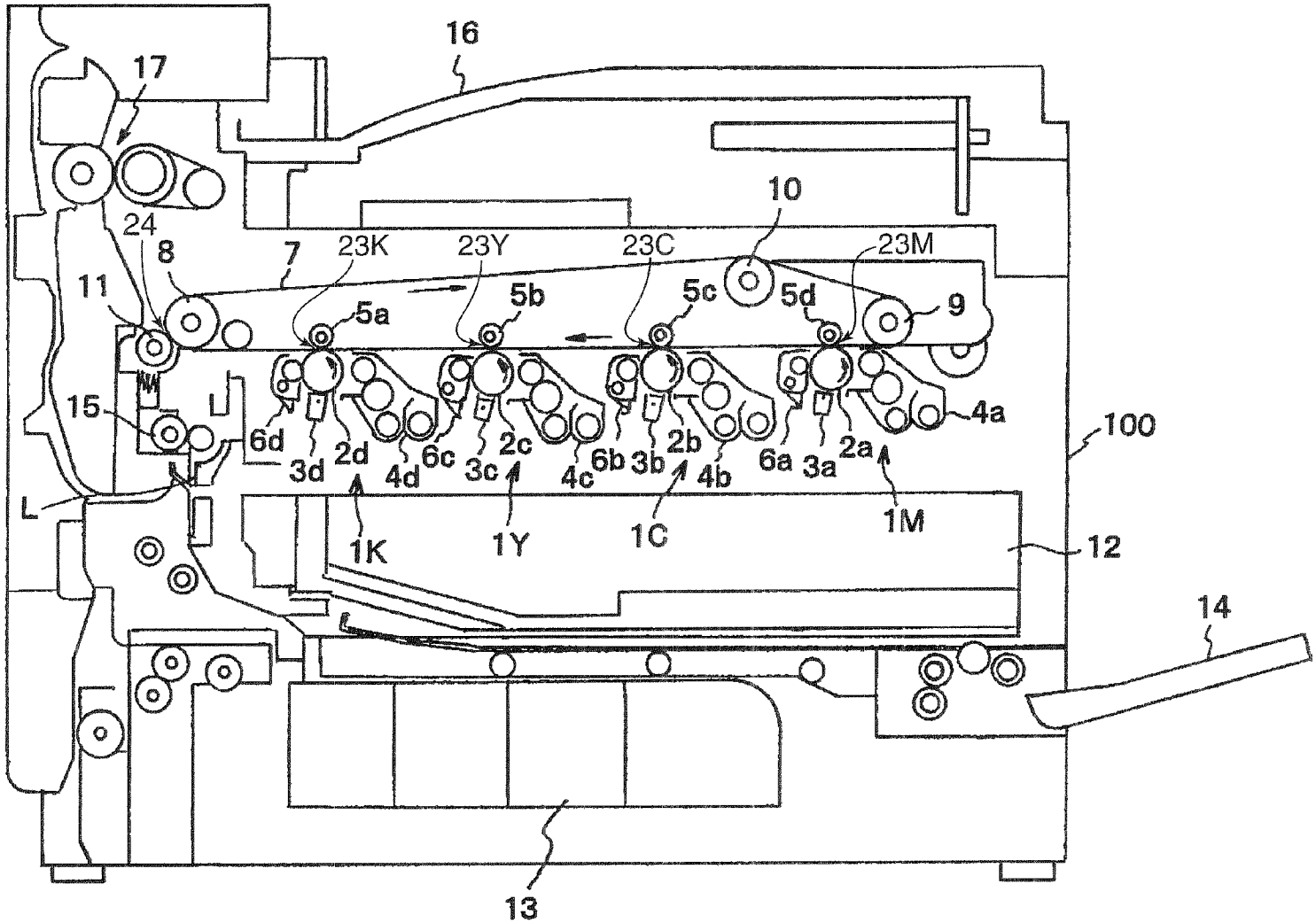
FIG. 1 is a cross-sectional diagram of an image forming apparatus (color laser printer) relating to the present invention.

FIG. 1 is a cross-sectional diagram of a color laser printer which is one mode of an image forming apparatus relating to the present invention. The depicted color laser printer is a tandem type printer. A magenta image forming unit 1M, a cyan image forming unit 1C, a yellow image forming unit 1Y and a black image forming unit 1K are disposed in tandem at prescribed intervals apart in the central part of a main body unit 100.

Photosensitive drums (an image carrying body) 2*a*, 2*b*, 2*c* and 2*d* are provided respectively in each of the image forming units 1M, 1C, 1Y and 1K. And, charging devices 3*a*, 3*b*, 3*c*, 3*d*, developer apparatuses 4*a*, 4*b*, 4*c*, 4*d*, transfer rollers 5*a*, 5*b*, 5*c*, 5*d*, and drum cleaning apparatuses 6*a*, 6*b*, 6*c*, 6*d* are disposed respectively about each of the photosensitive drums 2*a* to 2*d*.

Here, each of the photosensitive drums 2*a* to 2*d* is a drum-shaped photosensitive body, which is driven in rotation at a prescribed processing speed in the direction of the arrow in FIG. 1 (the counter-clockwise direction in FIG. 1) by a motor which is not illustrated. Furthermore, the charging devices 3*a* to 3*d* charge the surfaces of the photosensitive drums 2*a* to 2*d* uniformly to a prescribed potential, by means of a charging bias applied from a charging bias power source (not illustrated).

Moreover, the developer apparatuses 4*a* to 4*d* respectively accommodate developers of the colors magenta (toner M), cyan (C), yellow (Y) and black (K), which convert the respective electrostatic latent images formed on the photosensitive drums 2*a* to 2*d* into visible toner images of the respective colors by causing toners of the respective colors to adhere to the respective electrostatic latent images. Here, the developers of the respective colors are two-component developers comprising a toner and a carrier. Furthermore, as a toner, at least as a black toner, a magnetic toner containing a magnetic powder is used. The details of the developer apparatuses 4*a* to 4*d* are described below. Furthermore, the main body unit 100 comprises respective primary transfer units 23K, 23Y, 23C and 23M which transfer toner images of the respective colors of magenta (M), yellow (Y), cyan (C) and black (K) onto an intermediate transfer belt 7. These respective primary transfer units 23K, 23Y, 23C and 23M are provided so as to correspond to the colors of magenta (M), yellow (Y), cyan (C) and black (K).

Moreover, in each of the primary transfer units 23K, 23Y, 23C and 23M, the respective surfaces of the transfer rollers 5*a* to 5*d* and the respective surfaces of the photosensitive drums 2*a* to 2*d* are disposed so as to be mutually opposing. And, the respective surfaces of the transfer rollers 5*a* to 5*d* and the respective surfaces of the photosensitive drums 2*a* to 2*d* contact the respective surfaces of the intermediate transfer belt 7 and thereby nip the intermediate transfer belt 7. In this way, the position where the respective surfaces of the transfer rollers 5*a* to 5*d* and the respective surfaces of the photosensitive drums 2*a* to 2*d* contact the respective surfaces of the intermediate transfer belt 7 and nip the intermediate transfer belt 7 constitutes a so-called transfer nip section. The respective primary transfer units 23K, 23Y, 23C and 23M are constituted by transfer nip sections of this kind. The intermediate transfer belt 7 is provided in a tensed fashion by means of a secondary transfer opposing roller 8, a drive roller 9 and a tensioning roller 10. The intermediate transfer belt 7 of this kind is driven in rotation so as to pass through the plane which is disposed furthest in the upward direction, of the surfaces of the photosensitive drums 2*a* to 2*d* (the upward direction in FIG. 1). Furthermore, the secondary transfer opposing roller 8 and the secondary transfer roller 11 are disposed in such a manner that the surfaces of the secondary transfer opposing roller 8 and the secondary transfer roller 11 are mutually opposing. The surface of the secondary transfer opposing roller 8 and the surface of the secondary transfer roller 11 respectively contact the respective surfaces of the intermediate transfer belt 7 and thereby nip the intermediate transfer belt 7. In this way, the position where the surface of the secondary transfer opposing roller 8 and the surface of the secondary transfer roller 11 respectively contact the respective surfaces of the intermediate transfer belt 7 and nip the intermediate transfer belt 7 constitutes a so-called transfer nip section. The secondary transfer unit 24 is constituted by a transfer nip section of this kind. Although not shown in the drawings, a belt cleaning apparatus is provided in the vicinity of the drive roller 9.

Moreover, a laser scanner unit (LSU) 12 is disposed below the respective image forming units 1M, 1C, 1Y and 1K in the apparatus main body 100, and a paper supply cassette 13 is disposed detachably in the base portion of the main body 100 below same, and a manual feed tray 14 is provided in the side portion of the apparatus main body 100.

Furthermore, a resist roller pair 15 which supplies paper to the secondary transfer unit 24 formed by the contacting section between the secondary transfer opposing roller 8 and the secondary transfer roller 11 at a prescribed timing after waiting temporarily, is provided in the paper conveyance path L which extends in the vertical direction in the side portion of the main body unit 100.

Here the paper conveyance path L which is disposed in the vertical direction in one side portion inside the apparatus main body 100 extends until the paper output tray 16 which is provided on the upper surface of the apparatus main body 100, and a fixing apparatus 17 is provided at an intermediate point of the paper conveyance path L.

Next, an image forming operation performed by a color laser printer having the composition described above will be explained.

When an image formation start signal is issued, in each of the image forming units 1M, 1C, 1Y and 1K, the respective photosensitive drums 2*a* to 2*d* are driven in rotation at a prescribed processing speed in the direction of the arrow in FIG. 1 (the counter-clockwise direction), and these photosensitive drums 2*a* to 2*d* are charged uniformly by the charging devices 3*a* to 3*d*. Furthermore, the laser scanner unit 12 emits laser light which has been modulated by color image signals of the respective colors, this laser light is irradiated onto the surfaces of the photosensitive drums 2*a* to 2*d*, and electrostatic latent images corresponding to the color image signals of the respective colors are formed respectively on each of the photosensitive drums 2*a* to 2*d*.

Firstly, the developer apparatus 4*a* to which a developing bias of the same polarity as the charging polarity of the photosensitive drum 2*a* is applied deposits magenta toner onto the electrostatic latent image formed on the photosensitive drum 2*a* of the magenta image forming unit 1M, thereby converting the electrostatic latent image to a visible magenta toner image. In the primary transfer unit 23M (transfer nip section) between the photosensitive drum 2*a* and the transfer roller 5*a*, this magenta toner image is primarily transferred onto the intermediate transfer belt 7 which is driven to rotate in the direction of the arrow in FIG. 1, by the action of the transfer roller 5*a* to which a primary transfer bias of opposite polarity to the toner is applied.

The magenta toner image transferred primarily onto the intermediate transfer belt 7 as described above is moved to the cyan image forming unit 1C. In the cyan image forming unit 1C as well, similarly to the foregoing, the cyan toner image formed on the photosensitive drum 2*b* is transferred in a superimposed fashion onto the magenta toner image on the intermediate transfer belt 7, in the primary transfer unit 23C.

Thereafter in a similar fashion, in the respective primary transfer units 23Y and 23K, the yellow and black toner images which have been formed respectively on the photosensitive drums 2*c* and 2*d* of the yellow and black image forming units 1Y and 1K are superimposed successively on the magenta and cyan toner images which have been transferred in superimposed fashion onto the intermediate transfer belt 7, and thereby a full color toner image is formed on the intermediate transfer belt 7. The residual toner which is not transferred onto the intermediate transfer belt 7 but is left on the photosensitive drums 2*a* to 2*d* is removed by the drum cleaning apparatuses 6*a* to 6*d*, and the photosensitive drums 2*a* to 2*d* are prepared for the next image forming operation.

And, in synchronism with the timing at which the leading end of the full color toner image on the intermediate transfer belt 7 arrives at the secondary transfer unit 24 (transfer nip section) between the secondary transfer opposing roller 8 and the secondary transfer roller 11, the paper which has been supplied out to the paper conveyance path L from the paper supply cassette 13 or manual feed tray 14 is conveyed to the secondary transfer unit 24 by the pair of resist rollers 15. And, the full color toner image is transferred secondarily, in one operation, from the intermediate transfer belt 7 and onto the paper which has been conveyed to the secondary transfer unit 24, by the secondary transfer roller 11 to which a secondary transfer bias of opposite polarity to the toner is applied.

And, the paper to which the full color toner image has been transferred in this way is conveyed to the fixing apparatus 17, and the full color toner image is heated and pressurized and thermally fixed to the surface of the paper, whereupon the paper on which the toner image has been fixed is output to the paper output tray 16, thereby completing one sequence of an image forming operation. Meanwhile, residual toner which is not transferred to the paper but is left on the intermediate transfer belt 7 is removed by the belt cleaning apparatus (not illustrated), thereby preparing the intermediate transfer belt 7 for the next image forming operation.

Moreover, the color laser printer can perform not only a color image forming operation described above but also a black-and-white image forming operation. In this black-and-white image forming operation, the image forming unit 1K is used. In the image forming unit 1K, an electrostatic latent image is formed on the surface of the photosensitive drum 2*d* by the laser light modulated by a black color image signal.

Next, in the image forming unit 1K, the electrostatic latent image formed on the surface of the photosensitive drum 2*d* is converted to a visible black toner image by the developer apparatus 4*d*. And this black toner image is transferred onto the intermediate transfer belt 7, by the action of the transfer roller 5*a* to which a primary transfer bias of opposite polarity to the toner is applied.

And, the black toner image on the surface of the intermediate transfer belt 7 is transferred to the paper conveyed to the secondary transfer unit 24, by the secondary transfer roller 11 to which a secondary transfer bias of opposite polarity to the toner is applied.

And, the paper to which the black toner image has been transferred is conveyed to the fixing apparatus 17. And the black toner image is heated and pressurized and thermally fixed to the surface of the paper. And, the paper on which the black toner image has been fixed is output to the paper output tray 16.

[Developer Apparatus]

Next, the developer apparatuses 4*a* to 4*d* relating to the present invention are described with reference to FIG. 2.

Figure 2:
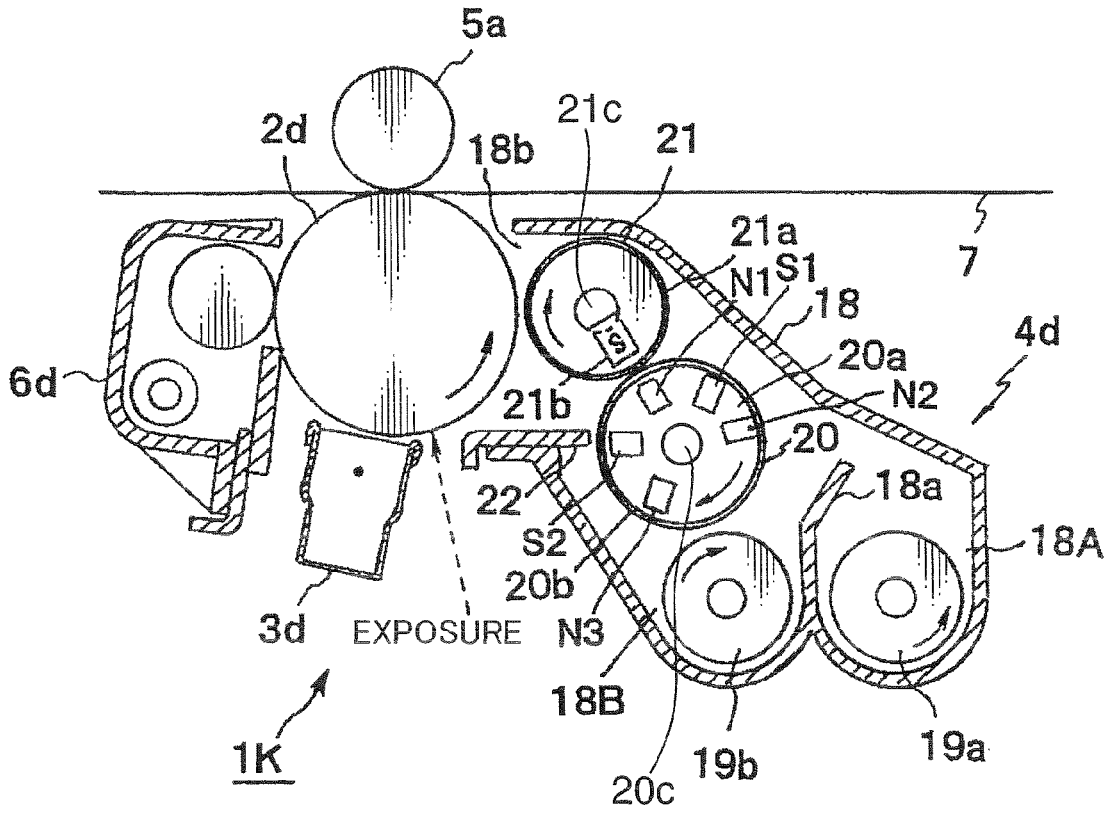
FIG. 2 is a cross-sectional diagram of a black image forming unit including the developer apparatus relating to the present invention.

FIG. 2 is a cross-sectional diagram of a black image forming unit 1K

The developer apparatus 4*d* shown in FIG. 2 accommodates a black two-component developer inside a developer container 18.

In the developer apparatus 4*d*, the interior of the developer container 18 is divided by a partitioning wall 18*a* into a first and a second accommodating chamber 18A and 18B. A first and a second churning roller 19*a* and 19*b* which are long in the direction perpendicular to the plane of the drawing in FIG. 2 are disposed in a respectively rotatable fashion in these first and second accommodating chambers 18A and 18B. When these first and second churning rollers 19*a* and 19*b* rotate, the two-component developer in the developer container 18 is conveyed in the axial direction (the direction perpendicular to the plane of the drawing in FIG. 2) while being churned, and is circulated between the first accommodating chamber 18A and the second accommodating chamber 18B by passing through a connecting path (not illustrated) which is formed in the partitioning wall 18*a*. Here, the magnetic toner which contains a magnetic powder is used at least as the black toner in the black two-component developer.

And this magnetic toner is a magnetic toner in which a saturated magnetization value in the range of 0.9 to 10 emu/g is obtained when a magnetic field having a field intensity of 1 kOe is applied to this magnetic toner.

A round cylindrical magnetic roller 20 which forms a two-component developer carrying body is provided rotatably above the second churning roller 19*b* inside the developer container 18, and a round cylindrical developing roller 21 which forms a toner carrying body is provided opposing the magnetic roller 20 in a position above the magnetic roller 20. Furthermore, as shown in FIG. 2, the developing roller 21 is disposed so as to oppose the photosensitive drum 2*d* via a prescribed gap and is exposed in an opening section 18*b* of the developer container 18.

The magnetic roller 20 described above comprises a non-magnetic rotating sleeve 20*b* inside which is provided a round cylindrical fixed magnet roller 20*a* having a plurality of magnetic poles (magnetic roller magnetic poles), and this rotating sleeve 20*b* is driven to rotate in the direction indicated by the arrow in FIG. 2 (clockwise direction) about a rotational axis 20*c* which forms a central line of rotation. The fixed magnetic roller 20*a* has three N poles where the outer circumferential direction forms an N pole (magnetic roller magnetic poles N1 to N3), and two S poles where the outer circumferential direction forms an S pole (magnetic roller magnetic poles S1 and S2), and along the direction of rotation of the rotating sleeve 20*b*, the magnetic roller magnetic pole S1 is disposed between the magnetic roller magnetic pole N1 (first magnetic member) and the magnetic roller magnetic pole N2, and the magnetic roller magnetic pole S2 is disposed between the magnetic roller magnetic pole N3 and the magnetic roller magnetic pole N1.

Here, the fixed magnet roller 20*a* is provided independently from the rotation of the rotating sleeve 20*b*. In other words, the fixed magnet roller 20*a* does not rotate even if the rotating sleeve 20*b* rotates. For example, if the magnetic roller 20*a* is not physically coupled to the rotational axis 20*c* and the rotating sleeve 20*b*, then it is possible to prevent the fixed magnet roller 20*a* from rotating even if the rotating sleeve 20*b* rotates. Furthermore, in the fixed magnet roller 20*a*, the magnetic roller magnetic poles N1 to N3 and S1 and S2 have a substantially rectangular parallelepiped shape of which the lengthwise direction extends in the axial direction of the rotational axis 20*c* and the breadthways direction extends in the radial direction of the fixed magnet roller 20*a*.

In a magnetic roller 20 of this kind, the rotating sleeve 20*b* is a round cylindrical member which forms the surface member of the magnetic roller 20. The rotating sleeve 20*b* rotates about the rotational center of the rotational axis 20*c* which is driven to rotate in the direction of the arrow in FIG. 2 (the clockwise direction), by means of a drive source (not shown). In so doing, two-component developer from the second churning roller 19*b* adheres to the surface of the rotating sleeve 20*b* due to the magnetic force created by the magnetic roller magnetic pole N3.

As the rotating sleeve 20*b* is rotated further, further two-component developer from the second churning roller 19*b* adheres to the rotating sleeve 20*b* due to the magnetic force created by the magnetic roller magnetic pole N3. In this way, due to the rotation of the rotating sleeve 20*b*, two-component developer is progressively supplied from the second churning roller 19*b* to the surface of the rotating sleeve 20*b*. When the two-component developer which has been supplied progressively to the surface of the rotating sleeve 20*b* in this way passes respectively by the magnetic roller magnetic poles N1 to N3 and S1 and S2 due to the rotation of the rotating sleeve 20*b*, the two-component developer is caused to stand erect in a direction perpendicular to the surface of the rotating sleeve 20*b*, by the magnetic force of the magnetic roller magnetic poles N1 to N3 and S1 and S2.

The two-component developer which has been caused to stand erect in the direction perpendicular to the surface of the rotating sleeve 20*b* in this way is called a "magnetic brush". The two-component developer which has been supplied progressively to the surface of the rotating sleeve 20*b* is conveyed in the rotating direction of the rotating sleeve 20*b* due to the rotation of the rotating sleeve 20*b*, while forming a magnetic brush on the sides adjacent to the magnetic roller magnetic poles N1 to N3 and S1 and S2.

Furthermore, the developing roller 21 is provided with a non-magnetic rotating sleeve 21*a*. In the developing roller 21, the rotating sleeve 21*a* is a round cylindrical member which forms the surface member of the developing roller 21. An opposing magnet 21*b* which is a second magnetic pole member is disposed at a position opposing the magnetic roller 20 inside of the rotating sleeve 21*a*.

Here, the rotating sleeve 21*a* is able to rotate about the central line of rotation of the rotational axis 21*c* in a linked fashion with the rotation of the rotational axis 21*c* which is driven to rotate in the direction of the arrow in FIG. 2 (the clockwise direction), by means of a drive source (not illustrated). For example, if the rotating sleeve 21*a* is physically coupled to the rotational axis 21*c*, then it is able to rotate about the central line of rotation of the rotational axis 21*c* in a linked fashion with the rotation of the rotational axis 21*c*. Furthermore, the opposing magnet 21*b* is provided independently of the rotation of the rotating sleeve 21*a*. In other words, the opposing magnet 21*b* does not rotate even when the rotating sleeve 21*a* rotates. For example, if the opposing magnet 21*b* is not physically coupled to the rotational axis 21*c* and the rotating sleeve 21*a*, then it is possible to prevent the opposing magnet 21*b* from rotating even if the rotating sleeve 21*a* rotates. And, the opposing magnet 21*b* has a substantially rectangular parallelepiped shape of which the lengthwise direction extends in the axial direction of the rotational axis 21*c* and the breadthways direction extends in the radial direction of the rotating sleeve 21*a*. More, the opposing magnet 21*b* may be a pillar shape having a fan-shaped cross-section, which extends in the axial direction of the rotational axis 21*c* of the rotating sleeve 21*a* (the direction perpendicular to the plane of the drawing in FIG. 2). If the opposing magnet 21*b* is formed as a pillar shape of this kind, then a fan-shaped cross-section is obtained in the section viewed in the axial direction of the rotational axis 21*c*.

In the present embodiment, the opposing magnet 21*b* is magnetized in such a manner that the outer circumferential direction of the rotating sleeve 21*a* forms an S pole which is of opposite polarity to the N1 pole of the fixed magnet roller 20*a*. The opposing magnet 21*b* of this kind functions as a developer roller magnetic pole. The magnetic force of the opposing magnet 21*b* in the perpendicular direction on the surface of the developing roller 21 is set to be equal to or greater than 25 mT and equal to or less than 40 mT. And, the rotating sleeve 21*a* of the developing roller 21 opposes the magnetic roller 20 at a prescribed gap apart from same at their position of opposition, and the developer roller magnetic pole S opposes the magnetic roller magnetic pole N1 at a prescribed gap apart from same at their position of opposition. And, the rotating sleeve 21*a* of the developing roller 21 is driven to rotate in the same direction as the rotating sleeve 20*b* of the magnetic roller 20 (the direction of the arrow in FIG. 2), and the directions of rotation of the rotating sleeves 20*b* and 21*a* are mutually opposite at their position of opposition.

Moreover, a doctor blade 22 which forms a toner layer thickness restricting member is installed on the developer container 18 along the axial direction of the rotating sleeve 20*b* (the direction perpendicular to the plane of the drawing in FIG. 2); this doctor blade 22 is disposed to the upstream side of the position of opposition of the sleeves 20*b* and 21*a* in the direction of rotation of the rotating sleeve 20*b* (the direction of the arrow in FIG. 2), and a prescribed narrow gap is formed between the leading end of the doctor blade 22 and the surface of the rotating sleeve 21*a*.

In the developer apparatus 4*d* having the composition described above, the two-component developer is churned and circulated inside the developer container 18 by the first and second churning rollers 19*a* and 19*b*, as stated previously. The toner becomes charged due to the churning of the two-component developer, and the two-component developer on the second churning roller 19*b* is attracted and conveyed by the magnetic roller 20. And, on the magnetic roller 20, a magnetic brush is formed by the magnetic roller magnetic pole S2 and the thickness of the layer is restricted by the doctor blade 22. Consequently, the thickness of the layer of two-component developer on the surface of the rotating sleeve 20*b* is restricted. And, the two-component developer having a layer thickness thus restricted is conveyed to a position opposing the developing roller 21 by the rotation of the rotating sleeve 20*b*. In a position of this kind, a magnetic brush composed of two-component developer is formed by the magnetic roller magnetic pole N1. And, the toner contained in the magnetic brush forms a thin layer of toner on the developing roller 21 due to the potential difference between the magnetic roller 20 and the developing roller 21, and the electrostatic latent image on the photosensitive drum 2*d* is developed by this thin layer of toner.

After carrying out development as described above, the developing roller 21 which bears residual toner that has not been developed arrives at the position of closest proximity to the magnetic roller 20 which is carrying a layer of two-component developer, at the position of opposition with respect to the magnetic roller 20, and the undeveloped toner on the developing roller 21 is swept away by the mechanical force created by the magnetic brush at this position of opposition, while at the same time the magnetic toner is supplied to the developing roller 21 from the layer of two-component developer on the magnetic roller 20 due to the potential difference (electric field) created between the magnetic roller 20 and the developing roller 21.

As stated above, since, at the position of opposition between the magnetic roller 20 and the developing roller 21, the rotating sleeves 20*b* and 21*a* are traveling in mutually opposite directions, and there is a developing roller magnetic pole S of opposite polarity exists opposing the magnetic roller magnetic pole N1, then a magnetic field is created between the magnetic roller magnetic pole N1 and the developer roller magnetic pole S, thereby strengthening the binding force of the magnetic brush and thus forming a satisfactory magnetic brush. Accordingly, the undeveloped toner on the developing roller 21 is swept away mechanically by the magnetic brush and is returned to the magnetic roller 20 side, and the undeveloped toner remaining on the developing roller 21 is recovered reliably to the magnetic roller 20 side, thus preventing the occurrence of ghost phenomenon (traces of previously developed images) caused by the history of previous toner consumption remaining in the thin layer of toner on the developing roller 21 due to defective recovery of the undeveloped toner.

Furthermore, by disposing a magnetic roller 20 below the developing roller 21 as in the present embodiment, the toner on the developing roller 21 is recovered efficiently to the magnetic roller 20 side under its own weight.

By the way, if the magnetic toner is used as in the present embodiment in a touchdown developer apparatus comprising a developing roller 21 that has an opposing magnet 21*b* disposed therein as a magnetic member, then the weight of the toner increases due to the fact that the magnetic toner contains magnetic powder, and the retaining force of the magnetic powder created by the magnetic force of the magnetic roller 20 also rises, which means that scattering of the toner from the magnetic roller 20 is suppressed, even if the toner concentration in the two-component developer is raised in order to increase the image output speed.

However, since the opposing magnet 21*b* is disposed inside the developing roller 21, then it becomes easier to move the magnetic toner by means of the effect of the magnetic field and furthermore, the retaining force of the magnetic toner created by the opposing magnet 21*b* is higher, when compared to a conventional touchdown development method which uses a non-magnetic toner. As a result of this, the thin layer of the toner on the developing roller 21 becomes thicker, thus leading to a problem in that, when the magnetic toner moves to a position where the magnetic field of the opposing magnet 21*b* inside the developing roller 21 has no effect, then the retaining force acting on the magnetic toner as a result of the magnetic force becomes weaker and the magnetic toner becomes more liable to scatter from the thin toner layer of increased thickness present on the developing roller 21. Furthermore, since the thin layer of toner in the developing roller 21 becomes thicker, then there is a problem in that the undeveloped toner becomes more difficult to recover from the developing roller 21.

Therefore, in the present embodiment, the increase in the thickness of the thin layer of toner on the developing roller 21 is suppressed by designing the opposing magnet 21*b* which is disposed inside of the developing roller 21 at a position opposing the magnetic roller 20 so as to have a magnetic force in the perpendicular direction on the surface of the developing roller 21 be equal to or greater than 25 mT and be equal to or lower than 40 mT. Consequently, even if the magnetic toner moves to a position which is unaffected by the magnetic field created by the opposing magnet 21*b*, it is not liable to be affected by the loss of the retaining force resulting from the magnetic force, and therefore scattering of the magnetic toner is suppressed. Consequently, even if the image output speed is raised, it is possible to achieve stable image formation as well as preventing soiling of the interior of the machine due to scattering of toner. Furthermore, in a touchdown development method, scattering of the toner is liable to occur when the undeveloped toner on the developing roller 21 is swept away and recovered mechanically by the magnetic brush. However, by using the magnetic toner, the following beneficial effects are achieved. More specifically, since the undeveloped magnetic toner on the developing roller 21 receives the effects of the magnetic roller magnetic pole N1 of the magnetic roller 20 and the magnetic force of the opposing magnet 21*b*, then it becomes less liable to scatter when recovered. Consequently, the recovery efficiency of the undeveloped toner is improved. Furthermore, desirably, the opposing magnet 21*b* which is disposed on the inside of the developing roller 21 at a position opposing the magnetic roller 20 has a magnetic force on the surface of the developing roller 21 be equal to or greater than 1 mT in the perpendicular direction. If the magnetic force is less than 1 mT, then in a high-speed machine, there is an increased requirement for raising the bias voltage in order to form a thin layer of toner, and hence toner scattering between the toner carrying body and the two-component developer carrying body becomes more liable to occur, and furthermore, a discharging phenomenon occurs between the toner carrying body and the two-component developer carrying body and this may lead to abnormalities in image formation. Furthermore, if the magnetic force of the opposing magnet 21*b* in the perpendicular direction on the surface of the developing roller 21 is in the range of 25 mT to 35 mT, then a suitable binding force is obtained for the magnetic brush created in the direction from the magnetic roller 20 toward the developing roller 21. Consequently, the load applied to the two-component developer is reduced and therefore deterioration of the two-component developer is suppressed.

Moreover, desirably, the magnetic roller magnetic pole N1 of the magnetic roller 21 is magnetized in such a manner that a magnetic force in the range of 80 mT to 100 mT is generated on the surface of the rotating sleeve 20*b* of the magnetic roller 21, in the direction perpendicular to the surface of the rotating sleeve 20*b*. If the magnetic roller magnetic pole N1 generates a magnetic force in the range of 80 mT to 100 mT in the direction perpendicular to the rotating sleeve 20*b* on the surface of the rotating sleeve 20*b*, the increase in the thickness of the thin layer of toner on the developing roller 21 is further suppressed. Consequently, even if the magnetic toner moves to a position which is unaffected by the magnetic field created by the opposing magnet 21*b*, the magnetic toner becomes even less liable to be affected by the loss of the retaining force created by the magnetic force. Consequently, scattering of the magnetic toner is further suppressed.

Moreover, in order to achieve the beneficial effects described above in a more suitable fashion, desirably, the magnetic roller magnetic pole N1 generates a magnetic force on the surface of the rotating sleeve 20*b* in the range of 85 mT to 95 mT in the direction perpendicular to the rotating sleeve 20*b*.

If the magnetic roller magnetic pole N1 generates a magnetic force on the surface of the rotating sleeve 20*b* of less than 80 mT in the perpendicular direction to the rotating sleeve 20*b*, then the carrier which should be on the magnetic roller 20 side may move to the developing roller 21 side due to the magnetic force of the opposing magnet 21*b*. Furthermore, if the magnetic force generated in the perpendicular direction to the rotating sleeve 20*b* exceeds 100 mT, then an excessively strong retaining force is exerted on the toner on the magnetic roller 20 side, and a suitable thin layer of toner may not be formed on the developing roller 21.

Furthermore, in the present embodiment, a saturated magnetization value of the range of 0.9 to 10 emu/g is obtained in the magnetic toner in a state where a magnetic field having a magnetic field intensity of 1 kOe was applied, and therefore scattering of the toner from the magnetic roller 20 is suppressed and the efficiency of the recovery of undeveloped toner from the developing roller 21 is raised. Moreover, the scattering of the toner from the developing roller 21 is also suppressed. Furthermore, since the saturated magnetization value of the magnetic toner is the range of 0.9 to 10 emu/g, then it can be seen that the amount of magnetic powder contained in the magnetic toner is lower than the magnetic toner which is used generally in magnetic single-component development method. Since this magnetic toner contains a smaller amount of magnetic powder, which is not melted by the fixing heat applied by the fixing apparatus 17, compared to general magnetic toners, then it can be seen that the ratio of the actual toner which is melted by the fixing heat is greater. Consequently, the fixing properties of the toner image are improved. Therefore, stable image formation is achieved. For comparison, if the saturated magnetization value of the magnetic toner is less than 0.1 emu/g in a state where a magnetic field having a magnetic field intensity of 1 kOe is applied, then sufficient effects may not be obtained on the basis of the magnetic force and the weight of the magnetic power in the magnetic toner, and furthermore, if the saturated magnetization value exceeds 10 emu/g, then the effects of the magnetic force become too strong and this has adverse effects on the development of the toner image and the recovery of undeveloped toner from the toner carrying body.

Consequently, according to the present invention, beneficial effects are obtained in that it is possible to raise the image output speed and achieve compatibility with high-speed machines while stable image formation and preventing soiling of the interior of the machine due to scattering of toner.

Figure 3:
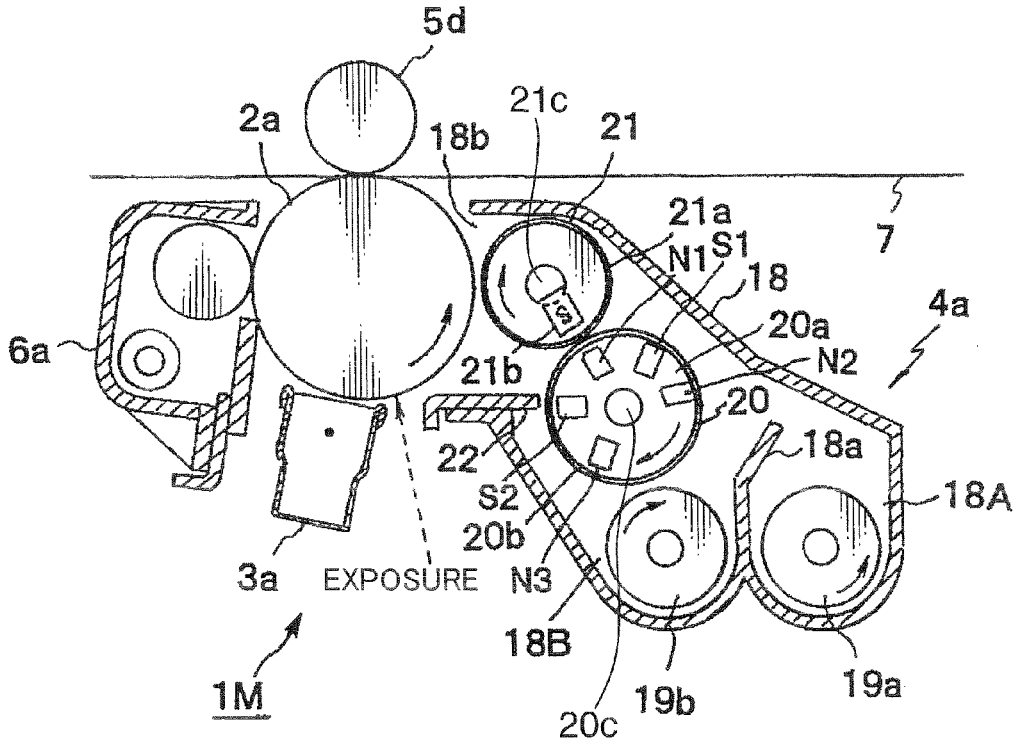
FIG. 3 is a cross-sectional diagram of a magenta image forming unit.

Meanwhile, as shown in FIG. 3, the composition of the developer apparatus 4*d* described above is adopted toward the developer apparatus 4*a* in the image forming unit 1M. And the developer apparatus 4*a* accommodates a magenta two-component developer containing the magnetic toner as the magenta color toner inside a developer container 18. Therefore the developer apparatus 4*a* can perform same performance as the developer apparatus 4*d*, thereby in the developer apparatus 4*a*, the above-mentioned beneficial effects are obtained.

Moreover, the respective developer apparatuses 4*b* and 4*c* have same composition as the developer apparatus 4*d* described above in the image forming unit 1C and 1Y respectively. And the developer apparatus 4*b* accommodates a cyan two-component developer containing the magnetic toner as the cyan color toner inside a developer container 18. And the developer apparatus 4*c* accommodates a yellow two-component developer containing the magnetic toner as the yellow color toner inside a developer container 18.

Therefore, the respective developer apparatuses 4*b* and 4*c* can perform same performance as the developer apparatus 4*d*, thereby in the respective developer apparatuses 4*b* and 4*c*, the above-mentioned beneficial effects are obtained.

Next, practical examples of the present invention are described with reference to comparative examples.

In the practical examples and comparative examples, image output was carried out using the following specifications and conditions.

Photosensitive drum: diameter ϕ 30 mm, circumferential speed 300 mm/sec., surface potential (dark potential) 300 V, light potential 10 V Rotating sleeve of developing roller: aluminum material, diameter ϕ 20 mm, circumferential speed 450 mm/sec Rotating sleeve of magnetic roller: aluminum material, diameter ϕ 25 mm, circumferential speed 675 mm/sec Magnetic force of magnetic roller magnetic poles: N1: 90 mT; S1: 80 mT; N2: 60 mT; N3: 40 mT; S2: 50 mT Conveyed amount of two-component developer by magnetic roller: 10 mg/cm$^2$ Gap between developing roller and magnetic roller: 350 μm Gap between developing roller and photosensitive drum: 150 μm Voltage applied to developing roller: Vdc2=300V, Vpp=1.6 kV, frequency f=2.7 kHz; duty ratio=50%

Voltage applied to magnetic roller: Vdc1=400V, Vpp=2.8 kV (opposite phase and same frequency as Vpp voltage applied to developing roller), frequency f=2.7 kHz, duty ratio=70%

Magnetic toner: volume-average particle size ϕ 6.5 μm, CV (coefficient of variation) value of numerical distribution: 23.5%

Carrier: Weight-average particle size ϕ 45 μm, saturated magnetization value 65 emu/g obtained in state where magnetic field having magnetic field intensity of 1 kOe is applied (the saturated magnetization value is measured in a magnetic field intensity of 79.6 kA/m (1 kOe) using a VSMM-P7 device manufactured by TPEI).

The magnetic toner used was manufactured by adding, to 100 parts by weight of styrene acrylic resin, 3 parts by weight of magnetic powder (made by Toda Kogyo Corp., saturated magnetization value of 50 emu/g obtained when a magnetic field having a magnetic field intensity of 1 kOe is applied), 4 parts by weight of carbon black (made by Mitsubishi Chemical Corp., product name: MA-100) and 2 parts by weight of a charge controlling agent (made by Fujikura Kasei Co., Ltd., product name: FCA201PS), and subjecting to a series of processes composed of a dissolving process, a kneading process, a crushing process, a sorting process and an external additive process. The Q/M ratio (amount of charge of the toner per unit weight) in the two-component developer at the start was 15 μC/g.

Furthermore, the CV value which indicates the volume-average particle size and the numerical distribution of the toner can be measured by using a Multisizer III (manufactured by Beckman Coulter) with an aperture diameter ϕ of 100 μm (measurement range 2.0 μm to 60 μm).

Using the specifications and conditions described above, 1000 printed sheets having a print ratio of 5% were output by variously altering the magnetic force of the opposing magnet and the saturated magnetization value obtained when a magnetic field having a magnetic field intensity of 1 kOe is applied, as indicated in Table 1, the toner scattering in each case was confirmed visually, and the recovery performance of the undeveloped toner was judged by visually confirming the occurrence or non-occurrence of ghost images (Practical Examples 1 to 7 and Comparative Examples 1 to 3). The saturated magnetization value of the toner was adjusted readily by altering the combination ratio of the magnetic powder.

In the evaluation of toner scattering and the recovery performance of undeveloped toner in Table 1, "excellent" indicates non occurrence of toner scattering or ghost images at all, "good" indicates slight occurrence observed of toner scattering and ghost images, and "bad" indicates clear occurrence of toner scattering and ghost images.

TABLE 1

| | MAGNETIC FORCE OF OPPOSING MAGNET (mT) | SATURATED MAGNETIZATION VALUE OF TONER (emu/g) | TONER SCATTERING | RECOVERY PERFORMANCE OF UNDEVELOPED TONER |
|---|---|---|---|---|
| PRACTICAL EXAMPLE 1 | 25 | 0.9 | EXCELLENT | EXCELLENT |
| PRACTICAL EXAMPLE 2 | 30 | 0.9 | EXCELLENT | EXCELLENT |
| PRACTICAL EXAMPLE 3 | 40 | 0.9 | EXCELLENT | EXCELLENT |
| COMPARATIVE EXAMPLE 1 | 45 | 0.9 | BAD | EXCELLENT |
| COMPARATIVE EXAMPLE 2 | 45 | 25 | BAD | BAD |
| PRACTICAL EXAMPLE 4 | 25 | 0.5 | GOOD | GOOD |
| PRACTICAL EXAMPLE 5 | 25 | 5 | EXCELLENT | EXCELLENT |
| PRACTICAL EXAMPLE 6 | 25 | 10 | EXCELLENT | EXCELLENT |
| PRACTICAL EXAMPLE 7 | 25 | 25 | GOOD | GOOD |
| COMPARATIVE EXAMPLE 3 | 25 | 0 | BAD | BAD |

As the Practical Examples 1 to 3 and the Practical Examples 5 and 6 shown in Table 1 clearly reveal, if the magnetic force generated by the opposing magnet in the perpendicular direction to the surface of the developing roller is equal to or greater than 25 mT and equal to or lower than 40 mT, and if the saturated magnetization value of the magnetic toner is the range of 0.9 to 10 emu/g, then scattering of toner is prevented and the recovery performance of the undeveloped toner is improved. Consequently, the beneficial effects of the present invention are proved.

In the description given above, the present invention is applied to a color laser printer. However, the present invention can also be applied to a monochrome image forming apparatus. Moreover, besides a printer, the present invention can also be applied to a copying machine or facsimile machine, or a machine combining these.

The concrete embodiment described above principally comprises an invention having the composition described below.

The developer apparatus relating to one aspect of the present invention is a developer apparatus comprising: a cylindrical two-component developer carrying body which carries a two-component developer comprising a toner composed of a magnetic toner containing magnetic powder, and a carrier; a cylindrical toner carrying body, which is provided opposing the two-component developer carrying body, and receives the toner from the two-component developer carrying body and carries the toner; and an image carrying body for developing an electrostatic latent image by means of the toner carried on the toner carrying body; wherein a first magnetic member is provided inside the two-component developer carrying body at a position opposing a surface of the toner carrying body, and a second magnetic member, which is magnetized to an opposite polarity to the first magnetic member and generates a magnetic force at least on the surface of the toner carrying body in a range of 25 mT to 40 mT in a direction perpendicular to the surface of the toner carrying body, is provided inside the toner carrying body at a position opposing the surface of the two-component developer carrying body.

According to this composition, a first magnetic member is provided inside the two-component developer carrying body at a position opposing the surface of a toner carrying body. The first magnetic member generates a so-called magnetic brush on the surface of the two-component developer carrying body.

Furthermore, a second magnetic member, which is magnetized to the opposite polarity to the first magnetic member and generates a magnetic force at least on the surface of the toner carrying body in the direction perpendicular to the surface of the toner carrying body, is provided inside the toner carrying body at a position opposing the surface of the two-component developer carrying body. This second magnetic member generates an electric field in the direction of one of the toner carrying body and the two-component developer carrying body, between itself and the first magnetic member which is provided inside the two-component developer carrying body.

Therefore, the magnetic brush which is generated at the position of greatest proximity to the toner carrying body on the surface of the two-component developer carrying body, receives the effects of a magnetic field in the direction of one of the toner carrying body and the two-component developer carrying body. Thereby, the so-called binding force which maintains the shape of the magnetic brush is further strengthened. Consequently, the undeveloped toner on the toner carrying body is readily removed by the magnetic brush. Furthermore, the toner contained in the magnetic brush is readily supplied to the toner carrying body.

Moreover, the magnetic force generated by the second magnetic member in the direction perpendicular to the surface of the toner carrying body is a magnetic force in the range of 25 mT to 40 mT. Therefore, increase in the thickness of the layer of toner on the toner carrying body is restricted and scattering of the toner is suppressed, even when the toner moves to a position where it is not affected by the second magnetic member. Consequently, even if the image output speed is raised, it is possible to achieve stable image formation, as well as preventing soiling of the interior of the machine due to scattering of toner.

In the composition described above, desirably, the toner yields a saturated magnetization value in a range of 0.9 to 10 emu/g in a state where a magnetic field having a magnetic field intensity of 1 kOe is applied.

According to this composition, scattering of the toner from the two-component developer carrying body is suppressed, and the efficiency of recovery of the undeveloped toner from the toner carrying body is improved. Moreover, scattering of toner from the toner carrying body is suppressed and the fixing properties of the toner image are also improved. Therefore, stable image formation is achieved.

In the composition described above, desirably, the first magnetic member is magnetized so as to generate a magnetic force on the surface of the two-component developer carrying body in a range of 80 mT to 100 mT in the direction perpendicular to the surface of the two-component developer carrying body.

According to this composition, the first magnetic member is magnetized so as to generate a magnetic force on the surface of the two-component developer carrying body in the range of 80 mT to 100 mT in the direction perpendicular to the surface of the two-component developer carrying body. Therefore, the following beneficial effects can be achieved reliably. More specifically, increase in the thickness of the toner layer on the toner carrying body is suppressed appropriately. Furthermore, scattering of the toner is suitably suppressed, even if the toner moves to a position where it is not affected by the second magnetic member. Consequently, even if the image output speed is raised, it is possible to achieve stable image formation as well as suitably preventing soiling of the interior of the machine due to scattering of toner.

In the composition described above, desirably, the first magnetic member is magnetized so as to generate a magnetic force on the surface of the two-component developer carrying body in a range of 85 mT to 95 mT in the direction perpendicular to the surface of the two-component developer carrying body. According to this composition, it is further possible to achieve stable image formation as well as suitably preventing soiling of the interior of the machine due to scattering of toner.

In the composition described above, desirably, the two-component developer carrying body and the toner carrying body rotate in a same direction.

According to this composition, since the direction of rotation of the two-component developer carrying body and the direction of rotation of the toner carrying body are the same, then the two-component developer carrying body rotates relatively in the opposite direction to the toner carrying body at the position on the surface of the toner carrying body that opposes the two-component developer carrying body. Consequently, the force sweeping away the undeveloped toner on the toner carrying body generated by the magnetic brush formed on the surface of the two-component developer carrying body becomes relatively stronger. Therefore, the efficiency of the recovery of undeveloped toner on the toner carrying body, to the two-component developer carrying body side, is further improved.

In the composition described above, desirably, the two-component developer carrying body is disposed below the toner carrying body. According to this composition, the undeveloped toner carried on the toner carrying body is recovered efficiently to the two-component developer carrying body side under its own weight.

In the composition described above, desirably, the second magnetic member generates a magnetic force on the surface of the toner carrying body in a range of 25 mT to 35 mT in the direction perpendicular to the surface of the toner carrying body.

According to this composition, the binding force of the magnetic brush created in the direction from the two-component developer carrying body toward the toner carrying body becomes a more suitable force. Consequently, the load applied to the two-component developer is reduced and therefore deterioration of the two-component developer is suppressed.

Furthermore, the image forming apparatus relating to a further aspect of the present invention is an image forming apparatus comprising: a developer apparatus which includes: a cylindrical two-component developer carrying body which carries a two-component developer comprising a toner composed of a magnetic toner containing magnetic powder, and a carrier; a cylindrical toner carrying body, which is provided opposing the two-component developer carrying body, and receives the toner from the two-component developer carrying body and carries the toner; and an image carrying body for developing an electrostatic latent image by means of the toner carried on the toner carrying body, wherein a first magnetic member is provided inside the two-component developer carrying body at a position opposing a surface of the toner carrying body, and a second magnetic member, which is magnetized to an opposite polarity to the first magnetic member and generates a magnetic force at least on the surface of the toner carrying body in a range of 25 mT to 40 mT in a direction perpendicular to the surface of the toner carrying body, is provided inside the toner carrying body at a position opposing the surface of the two-component developer carrying body; and a transfer apparatus which transfers a toner image formed on the surface of the image carrying body, onto paper.

According to this composition, the developer apparatus in claim 1 is provided. Therefore, an image forming apparatus is obtained in which, even if the image output speed is raised, it is possible to achieve stable image formation as well as preventing soiling of the interior of the machine due to scattering of toner.

In the composition described above, desirably, the toner yields a saturated magnetization value in a range of 0.9 to 10 emu/g in a state where a magnetic field having a magnetic field intensity of 1 kOe is applied. According to this composition, scattering of the toner from the two-component developer carrying body is suppressed, and the efficiency of recovery of the undeveloped toner from the toner carrying body is improved. Moreover, scattering of toner from the toner carrying body is suppressed and the fixing properties of the toner image are also improved. Therefore, an image forming apparatus capable of carrying out stable image formation is achieved.

In the composition described above, desirably, the first magnetic member is magnetized so as to generate a magnetic force on the surface of the two-component developer carrying body in a range of 80 mT to 100 mT in the direction perpendicular to the surface of the two-component developer carrying body. According to this composition, even if the image output speed is raised, it is possible to achieve stable image formation as well as suitably preventing soiling of the interior of the machine due to scattering of toner.

In the composition described above, desirably, the first magnetic member is magnetized so as to generate a magnetic force on the surface of the two-component developer carrying body in a range of 85 mT to 95 mT in the direction perpendicular to the surface of the two-component developer carrying body. According to this composition, it is further possible to achieve stable image formation as well as suitably preventing soiling of the interior of the machine due to scattering of toner.

In the composition described above, desirably, the second magnetic member generates a magnetic force on the surface of the toner carrying body in a range of 25 mT to 35 mT in the direction perpendicular to the surface of the toner carrying body. According to this composition, the load applied to the two-component developer is reduced and therefore deterioration of the two-component developer is suppressed.

This application is based on Japanese Patent Application Serial Nos. 2008-135045 and 2009-119118, filed in Japan Patent Office on May 23, 2008 and May 15, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developer apparatus, comprising:

a cylindrical two-component developer carrying body which carries a two-component developer comprising a toner composed of a magnetic toner containing magnetic powder, and a magnetic carrier;

a cylindrical toner carrying body opposing the two-component developer carrying body, the cylindrical toner carrying body receiving the toner from the two-component developer carrying body and carrying the toner;

an image carrying body for developing an electrostatic latent image by means of the toner carried on the toner carrying body, and a restricting mechanism that suppresses scattering of the magnetic toner from the toner carrying body and suppresses an increased thickness of a layer of the magnetic toner on the toner carrying body, wherein the restricting mechanism includes a first magnetic member provided inside the two-component developer carrying body at a position opposing a surface of the toner carrying body, the first magnetic member creating a retaining force to retain the magnetic toner on a circumferential surface of the cylindrical two-component developer carrying body, and a second magnetic member inside the toner carrying body at a position opposing the surface of the two-component developer carrying body and magnetized to a polarity opposite the first magnetic member, the second magnetic member creating a retaining force to the magnetic toner on a circumferential surface of the cylindrical toner carrying body, the first magnetic member is magnetized to generate a magnetic force on the surface of the two-component developer carrying body in a range of 80 mT to 100 mT in a direction perpendicular to the surface of the two-component developer carrying body, the second magnetic member generates a magnetic force at least on the surface of the toner carrying body in a range of 25 mT to 40 mT in the direction perpendicular to the surface of the toner carrying body, and the magnetic toner yields a saturated magnetization value in a range of 0.9 to 10 emu/g in a state where a magnetic field having a magnetic field intensity of 1 kOe is applied.

2. The developer apparatus according to claim 1, wherein the first magnetic member is magnetized so as to generate a magnetic force on the surface of the two-component developer carrying body in a range of 85 mT to 95 mT in the direction perpendicular to the surface of the two-component developer carrying body.

3. The developer apparatus according to claim 1, wherein the two-component developer carrying body and the toner carrying body rotate in a same direction.

4. The developer apparatus according to claim 1, wherein the two-component developer carrying body is disposed below the toner carrying body.

5. The developer apparatus according to claim 1, wherein the second magnetic member generates a magnetic force on the surface of the toner carrying body in a range of 25 mT to 35 mT in the direction perpendicular to the surface of the toner carrying body.

6. An image forming apparatus, comprising:

a developer apparatus which includes:

a cylindrical two-component developer carrying body which carries a two-component developer comprising a toner composed of a magnetic toner containing magnetic powder, and a magnetic carrier;

a cylindrical toner carrying body provided opposing the two-component developer carrying body, the cylindrical toner carrying body receiving the toner from the two-component developer carrying body and carrying the toner an image carrying body for developing an electrostatic latent image by means of the toner carried on the toner carrying body, and a restricting mechanism that suppresses scattering of the magnetic toner from the toner carrying body and suppresses an increased thickness of a layer of the magnetic toner on the toner carrying body, wherein the restricting mechanism includes a first magnetic member provided inside the two-component developer carrying body at a position opposing a surface of the toner carrying body, the first magnetic member creating a retaining force to retain the magnetic toner on a circumferential surface of the cylindrical two-component developer carrying body, and a second magnetic member inside the toner carrying body at a position opposing the surface of the two-component developer carrying body and magnetized to an opposite polarity to the first magnetic member, the second magnetic member creating a retaining force to the magnetic toner on a circumferential surface of the cylindrical toner carrying body, the first magnetic member is magnetized to generate a magnetic force on the surface of the two-component developer carrying body in a range of 80 mT to 100 mT in a direction perpendicular to the surface of the two-component developer carrying body, the second magnetic member generates a magnetic force at least on the surface of the toner carrying body in a range of 25 mT to 40 mT in the direction perpendicular to the surface of the toner carrying body, the magnetic toner yields a saturated magnetization value in a range of 0.9 to 10 emu/g in a state where a magnetic field having a magnetic field intensity of 1 kOe is applied; and the image forming apparatus further comprises a transfer apparatus which transfers a toner image formed on the surface of the image carrying body, onto paper.

7. The image forming apparatus according to claim 6, wherein the first magnetic member is magnetized so as to generate a magnetic force on the surface of the two-component developer carrying body in a range of 85 mT to 95 mT in the direction perpendicular to the surface of the two-component developer carrying body.

8. The image forming apparatus according to claim 6, wherein the second magnetic member generates a magnetic force on the surface of the toner carrying body in a range of 25 mT to 35 mT in the direction perpendicular to the surface of the toner carrying body.

* * * * *